US007600907B2

(12) United States Patent
Liu et al.

(10) Patent No.: US 7,600,907 B2
(45) Date of Patent: Oct. 13, 2009

(54) LED LIGHTING DEVICE

(75) Inventors: Yen-Fu Liu, Hsin-Tien (TW); Hung-Hsin Lee, Hsin-Tien (TW)

(73) Assignee: Ledtech Electronics Corp., Hsin-Tien, Taipei Hsien (TW)

( * ) Notice: Subject to any disclaimer, the term of this patent is extended or adjusted under 35 U.S.C. 154(b) by 213 days.

(21) Appl. No.: 11/859,692

(22) Filed: Sep. 21, 2007

(65) Prior Publication Data

US 2009/0040782 A1 Feb. 12, 2009

(30) Foreign Application Priority Data

Aug. 8, 2007 (TW) ..... 96213064 U

(51) Int. Cl.
*F21V 7/04* (2006.01)

(52) U.S. Cl. ..... 362/555; 362/581; 362/35; 362/249.03; 362/269; 362/287; 362/396; 362/438

(58) Field of Classification Search ..... 362/555, 362/581, 35, 249.03, 269, 287, 418, 396, 362/438
See application file for complete search history.

(56) References Cited

U.S. PATENT DOCUMENTS 4,779,178 A * 10/1988 Spitz ..... 362/260
5,803,585 A * 9/1998 Littman et al. ..... 362/147
6,036,337 A * 3/2000 Belfer ..... 362/287
6,843,581 B2 * 1/2005 Mier-Langner et al. ..... 362/220
2002/0089851 A1 * 7/2002 Jamison ..... 362/287

* cited by examiner

*Primary Examiner*—Sandra L O'Shea
*Assistant Examiner*—Evan Dzierzynski
(74) *Attorney, Agent, or Firm*—Pai Patent & Trademark Law Firm; Chao-Chang David Pai

(57) ABSTRACT

An LED lighting device includes a light pipe and a support portion. The light pipe includes a light emitting diode module inside and two first fastening portions on an outer wall thereof. A support portion secures the light pipe and provides a rotatable function for the light pipe. The support portion further includes a clamp and a base member. A clamp has two second fastening portions at opposite sides thereof. The second fastening portions engage with the first fastening portions. The clamp further includes a strip hollow slot. A base member includes a pair of positioning portions for holding an outer wall of the clamp, wherein a fastener is led through the strip hollow slot and fastened on the base member. The clamp slides relative to the base member along the strip hollow slot such that the light pipe rotates relative to the base member.

14 Claims, 3 Drawing Sheets

LED LIGHTING DEVICE

CROSS-REFERENCE TO RELATED APPLICATION

This application claims the priority benefit of Taiwan application serial no. 96213064, filed Aug. 8, 2007, the full disclosure of which is incorporated herein by reference.

BACKGROUND

1. Field of Invention

The present invention relates to an illumination device. More particularly, the present invention relates to an illumination device with adjustable light emitting direction.

2. Description of Related Art

As LED-manufacturing technology advances rapidly, various illumination devices utilize light emitting diodes as their light emitting sources so as to prolong emitting life and increase brightness.

For instance, some cathode lamps have been replaced by a light tube containing LED arrays. A conventional cathode lamp is of circular-cylindrical shape to have a broad light emitting range. Nevertheless, the light tube containing LED arrays cannot possess a broad light emitting range due to its uni-directional light emitting even if it is equipped with a circular-cylindrical housing. For the forgoing reasons, there is a need for improving a conventional light tube containing LED arrays.

SUMMARY

An LED lighting device includes a light pipe and a support portion. The light pipe includes a light emitting diode module inside and a pair of first fastening portions on an outer wall thereof. A support portion secures the light pipe and provides a rotatable function for the light pipe. The support portion further includes an arc-shaped clamp and a base member. An arc-shaped clamp has a pair of second fastening portions at opposite sides thereof. The pair of second fastening portions engages with the pair of first fastening portions. The arc-shaped clamp further includes a strip hollow slot. A base member includes a pair of positioning portions for holding an outer wall of the arc-shaped clamp, wherein a fastener is led through the strip hollow slot and fastened on the base member. The arc-shaped clamp slides relative to the base member along the strip hollow slot such that the light pipe rotates relative to the base member.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
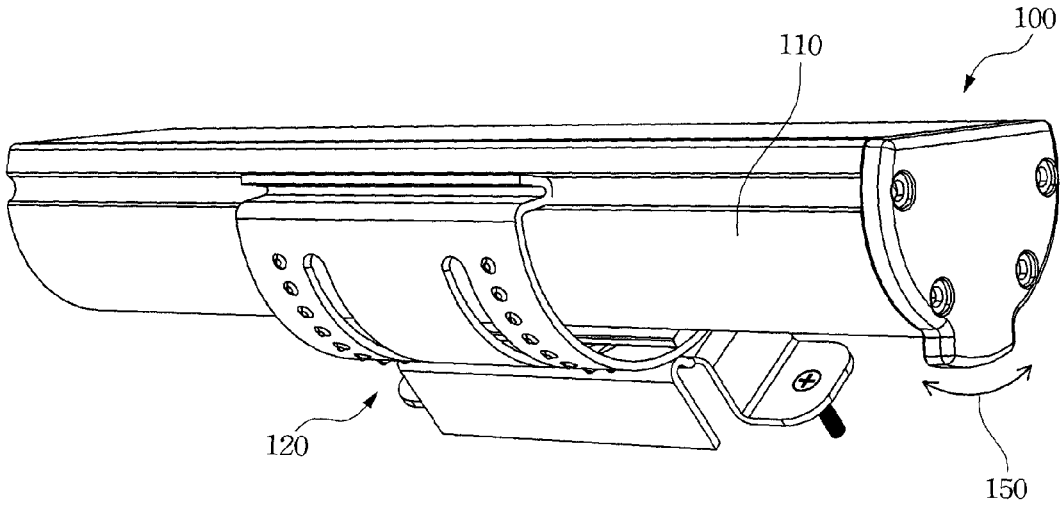
FIG. 1 illustrates an LED lighting device as described in an embodiment herein.

Reference will now be made in detail to the present preferred embodiments of the invention, examples of which are illustrated in the accompanying drawings. Wherever possible, the same reference numbers are used in the drawings and the description to refer to the same or like parts.

Figure 2:
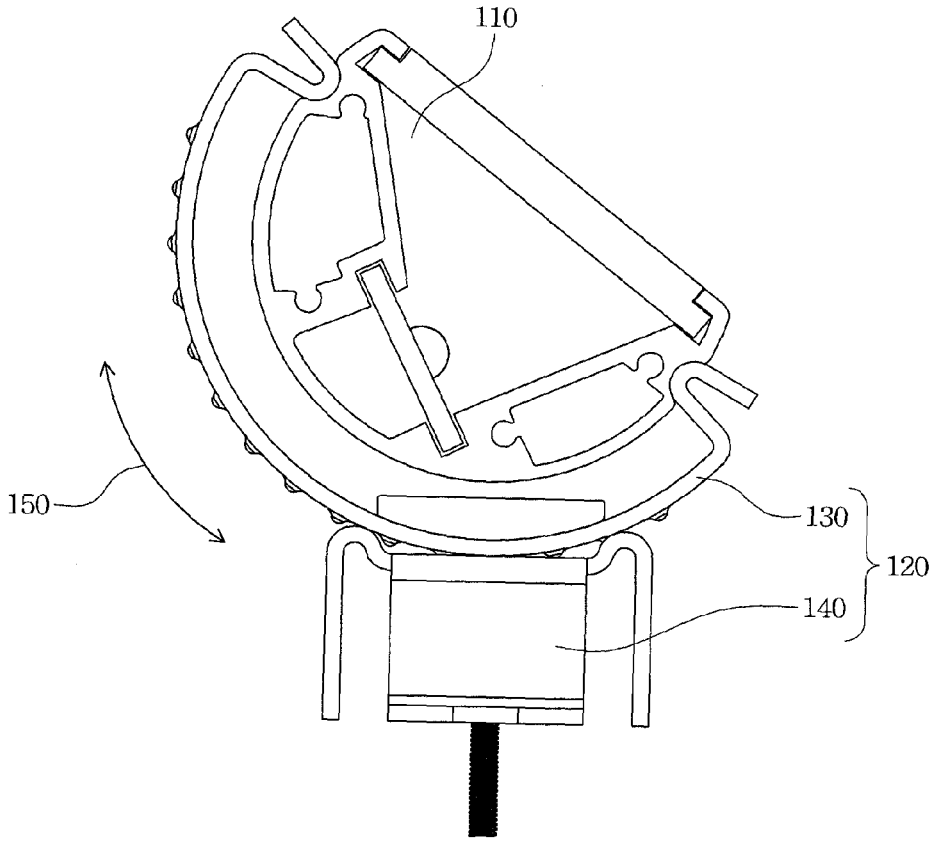
FIG. 2 illustrates a cross-sectional view of the LED lighting device as illustrated in FIG. 1.

FIG. 1 illustrates an LED lighting device as described in an embodiment herein. FIG. 2 illustrates a cross-sectional view of the LED lighting device as illustrated in FIG. 1. The LED (light emitting diode) lighting device 100 mainly consists of a light pipe 110 and a support portion 120. The support portion 120 provides the light pipe 110 a rotatable function such that users can adjust a light emitting direction of the light pipe 110 at will. The support portion 120 includes a clamp 130 and a base member 140. The clamp 130 is capable of sliding relative to the base member 140 along a direction 150. As the clamp 130 holds the light pipe 110, the light pipe 110 rotates relative to the base member 140 along the direction 150 so as to achieve the purpose of adjusting the light emitting direction. In this embodiment, a cross-section of the arc-shaped clamp 130 is concentric to a semicircular cross-section of the light pipe 110.

Figure 3:
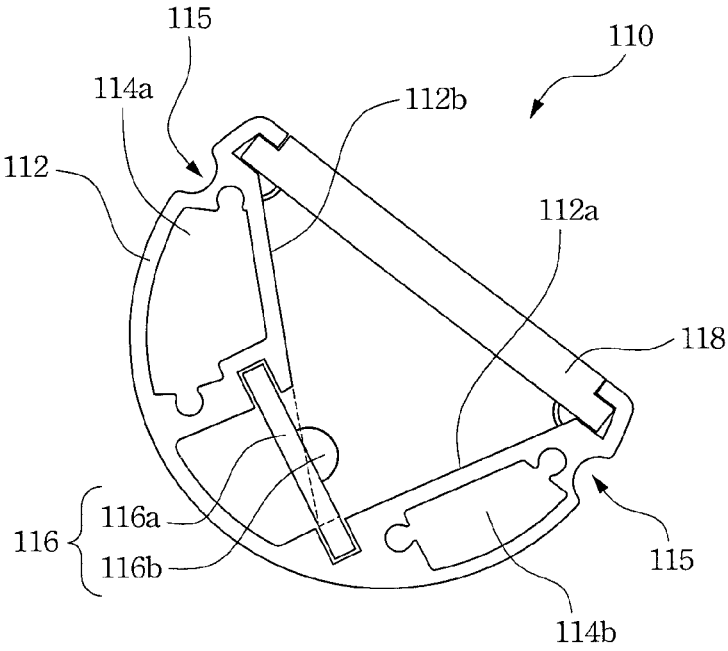
FIG. 3 illustrates a cross-sectional view of a light pipe of the LED lighting device as illustrated in FIG. 1.

FIG. 3 illustrates a cross-sectional view of a light pipe of the LED lighting device as illustrated in FIG. 1. In this embodiment, the light pipe 110 can be detachable from the clamp 130. Thus, the light pipe 110 can be replaced by a new one when the light pipe 110 is damaged. The light pipe 110 includes an opaque housing 112 and a transparent emitting flat sheet 118. The housing 112 has a pair of fastening portions (such as concave sections 115) on its outer wall to be easily held by the clamp 130. The concave sections 115 extend along a long axis of the light pipe 110. Hollow spaces can be formed within the housing 112 to decrease weight. In this embodiment, two hollow spaces 114*a*/114*b* penetrates through the housing 112 along a long axis of the light pipe 110. The transparent emitting flat sheet 118 assembles with housing 112 so as to seal a light emitting diode module 116 inside. The light emitting diode module 116 consists of a substrate 116*a* and a light emitting diode array 116*b*. Two edges of the substrate 116*a* engage with a pair of slots within the housing 112, thereby securing the light emitting diode module 116. A first reflective surface 112*a* and a second reflective surface 112*b* within the housing 112 reflect the emitting light from the light emitting diode module 116 toward a desired direction. In this embodiment, the transparent emitting flat sheet 118 and extension surfaces (illustrated as dashed line in FIG. 3) of the first reflective surface 112*a* and the second reflective surface 112*b* together define a hollow triangular cylinder. The first reflective surface 112*a* and the second reflective surface 112*b* are not arranged in a symmetrical way (relative to the light emitting diode module 116). Specifically, an included angle between the transparent emitting flat 118 and the first reflective surface 112*a* is unequal to an included angle between the transparent emitting flat 118 and the second reflective surface 112*b*.

Figure 4:
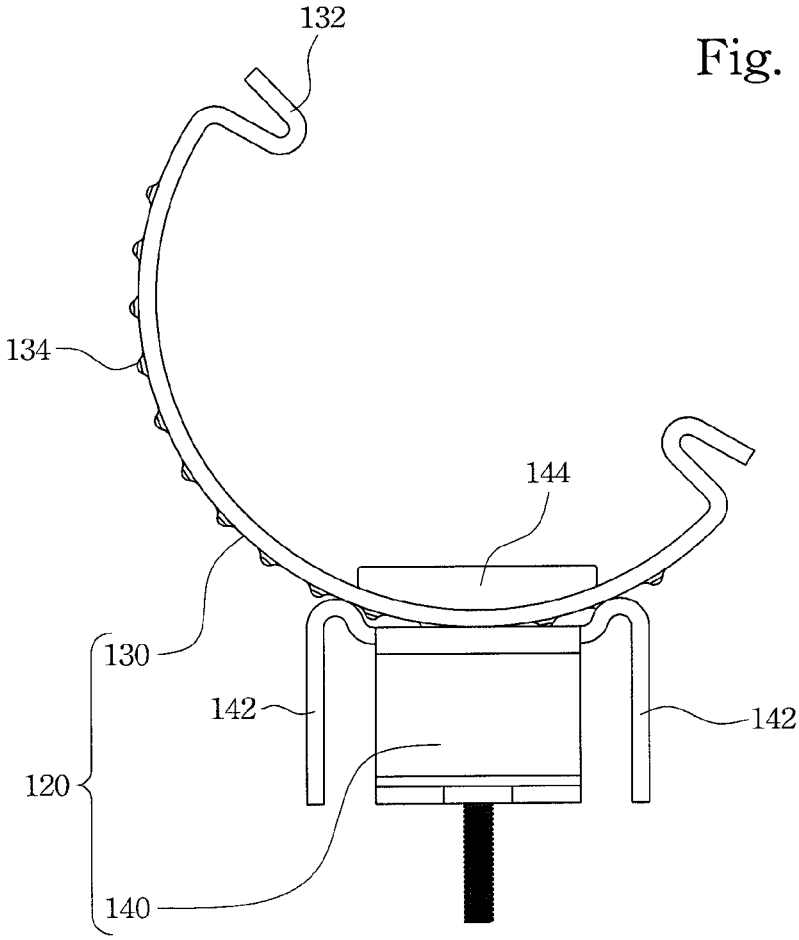
FIG. 4 illustrates a cross-sectional view of a support portion of the LED lighting device as illustrated in FIG. 1.
Figure 5:
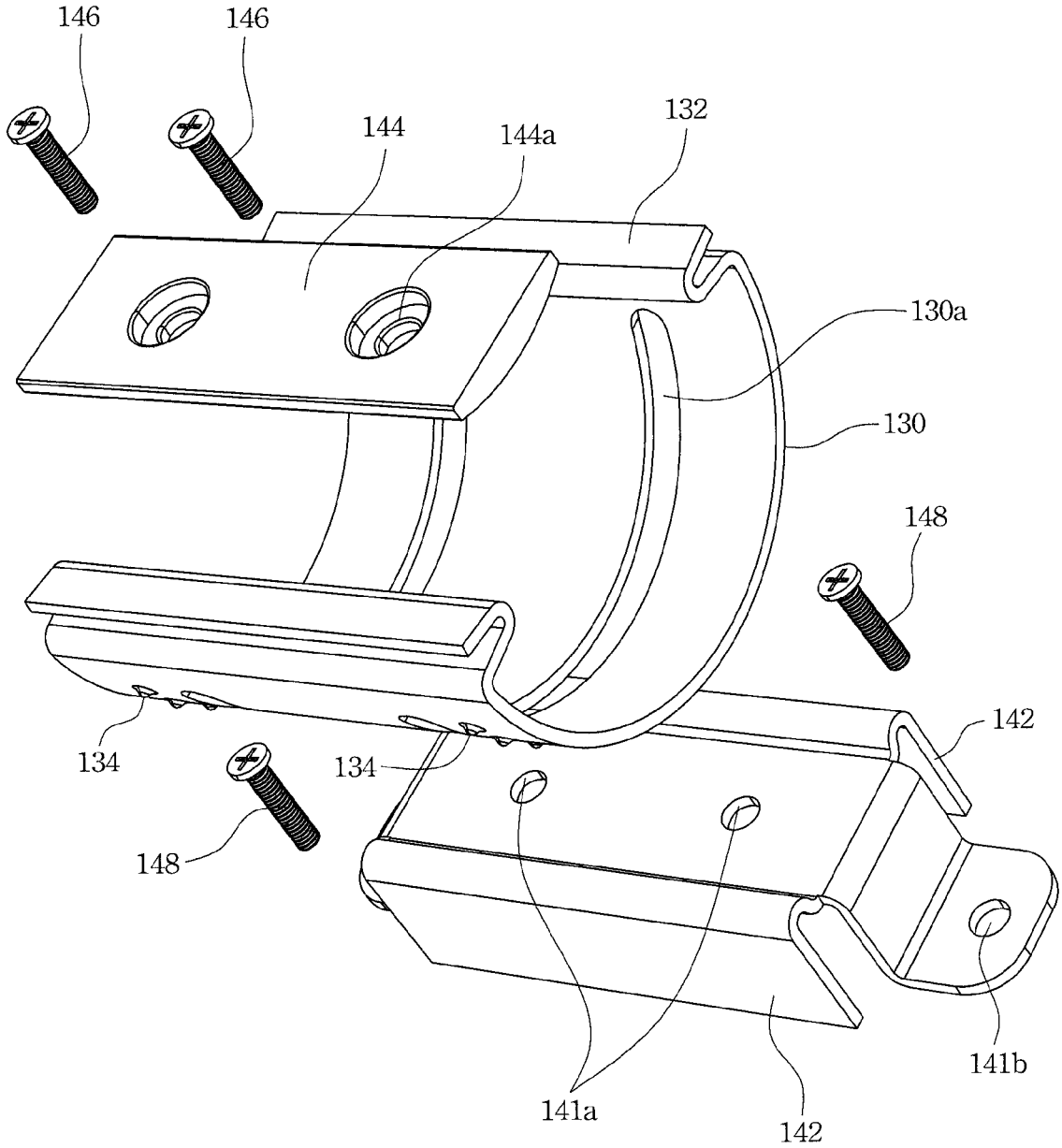
FIG. 5 illustrates an exploded view of the support portion of the LED lighting device as illustrated in FIG. 1.

FIG. 4 illustrates a cross-sectional view of a support portion of the LED lighting device as illustrated in FIG. 1. FIG. 5 illustrates an exploded view of the support portion of the LED lighting device as illustrated in FIG. 1. The support portion 120 includes a clamp 130 and a base member 140. The arc-shaped clamp 130 could slide relative to the base member 140, which has two holes 141*b* for screws 148 to be screwed on a wall. In this embodiment, the clamp 130 is an arc-shaped clamp, which has a pair of second fastening portions (such as hooks 132) at two opposite sides thereof. Two hooks 132 are respectively to engage with two concave sections 115 (as illustrated in FIG. 3) so as to hold the light pipe 110. Two strip hollow slots 130*a* are formed on the clamp 130. A fastener (such as a bolt 146) can be led through the strip hollow slot 130*a* and be screwed into screw holes 141*a* of the base member 140 (or using nut to screw on the bolt 146). A fastening member 144 may be used to secure the clamp 130 to the base member 140. The fastening member 144 includes two screw holes 144*a*, and two bolts 146 can be led through the screw hole 144*a* and the strip hollow slot 130*a* in series and be screwed into screw holes 141*a* of the base member 140. In order to position the clamp 130, which is sliding relative to the base member 140, two rows of convex members 134 are formed in parallel with two strip hollow slots 130*a*, and the base member 140 has a pair of positioning portions, which respectively extends outward from two opposite sides of the base member 140 to form two positioning wings 142. The two positioning wings 142 hold the outer wall of the arc-shaped clamp 130. When the positioning wing 142 engages between two adjacent convex members 134, the clamp 130 is temporarily positioned. In this embodiment, two rows of convex members 134 are located between two strip hollow slots 130*a*. However, the position relationship between convex members 134 and two strip hollow slots 130*a* can be rearranged according to demands. In addition, the base member 140 may position the arc-shaped clamp 130 by directly holding its outer wall even if no convex members 134 are formed thereon.

According to embodiments discussed above, users can adjust a light emitting direction of the LED lighting device as described an embodiment herein at will. Moreover, a light pipe of the LED lighting device is detachable such that a new one can replace the original light pipe, which is damaged.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An LED lighting device, comprising:

a light pipe, comprising a light emitting diode module inside and a pair of first fastening portions on an outer wall thereof;

a support portion for securing the light pipe and providing a rotatable function for the light pipe, the support portion comprising:

an arc-shaped clamp, comprising a pair of second fastening portions at opposite sides thereof, the pair of second fastening portions engaging with the pair of first fastening portions, the arc-shaped clamp further comprising a strip hollow slot; and a base member, comprising a pair of positioning portions for holding an outer wall of the arc-shaped clamp, wherein a fastener is led through the strip hollow slot and fastened on the base member, the arc-shaped clamp slides relative to the base member along the strip hollow slot such that the light pipe rotates relative to the base member.

2. The LED lighting device of claim 1, wherein the light pipe comprises a semicircular cross-section, which is concentric with a cross-section of the arc-shaped clamp.

3. The LED lighting device of claim 1, wherein the light pipe comprises a housing and a transparent emitting flat sheet.

4. The LED lighting device of claim 3, wherein the light pipe further comprises a first reflective surface and a second reflective surface inside the housing, the transparent emitting flat sheet and extension surfaces of the first reflective surface and the second reflective surface together define a hollow triangular cylinder.

5. The LED lighting device of claim 4, wherein an included angle between the transparent emitting flat and the first reflective surface is unequal to an included angle between the transparent emitting flat and the second reflective surface.

6. The LED lighting device of claim 5, wherein the housing comprises a hollow space penetrating through the housing.

7. The LED lighting device of claim 1, wherein the base member comprises two holes such that screws is led through the holes to secure the base member on a wall.

8. The LED lighting device of claim 1, further comprising a fastening member for securing the arc-shaped clamp to the base member, wherein the arc-shaped clamp is sandwiched between the positioning member and the base member.

9. The LED lighting device of claim 1, wherein the outer wall of the arc-shaped clamp further comprises a plurality of convex members arranged in parallel with the strip hollow slot.

10. The LED lighting device of claim 9, wherein the convex members are arranged along two rows.

11. The LED lighting device of claim 10, wherein the strip hollow slot is located between the two rows of convex members.

12. The LED lighting device of claim 1, wherein the pair of first fastening portions is a pair of concave sections.

13. The LED lighting device of claim 12, wherein the pair of second fastening portions is a pair of hooks.

14. The LED lighting device of claim 1, wherein the pair of positioning portions respectively extend outward from two opposite sides of the base member to form two positioning wings.

* * * * *